US011842841B2

(12) United States Patent
Kwon et al.

(10) Patent No.: US 11,842,841 B2
(45) Date of Patent: Dec. 12, 2023

(54) COIL COMPONENT

(71) Applicant: SAMSUNG ELECTRO-MECHANICS CO., LTD., Suwon-si (KR)

(72) Inventors: Sang Kyun Kwon, Suwon-si (KR); Jong Ho Chung, Suwon-si (KR); Chul Min Sim, Suwon-si (KR); Seong Jae Lee, Suwon-si (KR); Han Wool Ryu, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 933 days.

(21) Appl. No.: 16/666,968

(22) Filed: Oct. 29, 2019

(65) Prior Publication Data

US 2020/0411227 A1 Dec. 31, 2020

(30) Foreign Application Priority Data

Jun. 25, 2019 (KR) ..... 10-2019-0075757

(51) Int. Cl.

| | |
|---|---|
| ***H01F 27/28*** | (2006.01) |
| ***H01F 27/255*** | (2006.01) |
| ***H01F 41/04*** | (2006.01) |
| ***H01F 27/29*** | (2006.01) |

(52) U.S. Cl.

CPC ..... *H01F 27/2804* (2013.01); *H01F 27/255* (2013.01); *H01F 27/29* (2013.01); *H01F 41/041* (2013.01); *H01F 2027/2809* (2013.01)

(58) Field of Classification Search

CPC .... H01F 27/2804; H01F 27/255; H01F 27/29; H01F 41/041; H01F 2027/2809

See application file for complete search history.

(56) References Cited

U.S. PATENT DOCUMENTS

| | | | |
|---|---|---|---|
| 2008/0041496 A1 | 2/2008 | Maeda et al. | |
| 2008/0061264 A1 | 3/2008 | Maeda et al. | |
| 2016/0151836 A1* | 6/2016 | Matsutani | C22C 38/02 252/62.55 |

(Continued)

FOREIGN PATENT DOCUMENTS

| | | |
|---|---|---|
| JP | 4507663 B2 | 7/2010 |
| JP | 4650073 B2 | 3/2011 |

(Continued)

OTHER PUBLICATIONS

Korean Office Action dated Jun. 23, 2019 issued in Korean Patent Application No. 10-2019-0075757 (with English translation).

(Continued)

*Primary Examiner* — Carlos Amaya

(74) *Attorney, Agent, or Firm* — Morgan, Lewis & Bockius LLP

(57) ABSTRACT

A coil component includes a body having a coil portion embedded therein; and external electrodes connected to the coil portion, wherein the body includes a plurality of magnetic metal particles, and a plurality of indentations are formed in surfaces of at least some of the plurality of magnetic metal particles, and the surfaces of the magnetic metal particles connecting the plurality of indentations to each other are spherical.

15 Claims, 6 Drawing Sheets

(56) References Cited

U.S. PATENT DOCUMENTS

| | | | | |
|---|---|---|---|---|
| 2016/0218691 | A1* | 7/2016 | Park | H01F 27/022 |
| 2016/0276074 | A1 | 9/2016 | Lee et al. | |
| 2018/0096783 | A1 | 4/2018 | Fukuda et al. | |
| 2019/0055635 | A1* | 2/2019 | Kwon | C22C 38/20 |
| 2019/0122793 | A1 | 4/2019 | Kwon et al. | |
| 2020/0111609 | A1* | 4/2020 | Sato | H01F 41/046 |
| 2020/0373045 | A1* | 11/2020 | Ohta | C22C 38/26 |

FOREIGN PATENT DOCUMENTS

| | | | |
|---|---|---|---|
| JP | 2013-247214 | A | 12/2013 |
| JP | 2014-078629 | A | 5/2014 |
| JP | 2018-056505 | A | 4/2018 |
| KR | 10-2016-0112480 | A | 9/2016 |
| KR | 10-2017-0089188 | A | 8/2017 |
| KR | 10-2019-0044394 | A | 4/2019 |
| WO | 2015/019576 | A1 | 2/2015 |

OTHER PUBLICATIONS

Japanese Office Action dated Jun. 30, 2020 issued in Japanese Patent Application No. 2019-196179 (with English translation).

* cited by examiner

COIL COMPONENT

CROSS-REFERENCE TO RELATED APPLICATION(S)

This application claims the benefit of priority to Korean Patent Application No. 10-2019-0075757 filed on Jun. 25, 2019 in the Korean Intellectual Property Office, the disclosure of which is incorporated herein by reference in its entirety.

TECHNICAL FIELD

The present disclosure relates to a coil component.

BACKGROUND

In accordance with the miniaturization and thinning of electronic devices such as a digital television (TV), a mobile phone, a laptop computer, and the like, the miniaturization and thinning of coil components used in such electronic devices have been demanded. In order to satisfy such demand, research and development of various winding type or thin film type coil components have been actively conducted.

An issue depending on the miniaturization and the thinning of the coil component is to implement characteristics equal to characteristics of an existing coil component in spite of the miniaturization and the thinning. In order to satisfy such demand, a ratio of a magnetic material should be increased in a core in which the magnetic material is filled. However, there is a limitation to increasing the ratio due to a change in strength of a body of an inductor, frequency characteristics depending on an insulation property of the body, and the like.

As an example of a method of manufacturing the coil component includes implementing the body by stacking and then pressing sheets in which magnetic particles, a resin, and the like, are mixed with each other on coils. As an example of the magnetic particle, an Fe-based alloy, or the like, has been used in order to increase a saturation magnetic flux density.

SUMMARY

An aspect of the present disclosure may provide a coil component including magnetic metal particles and having an improved magnetic permeability. Another aspect of the present disclosure may provide a coil component of which magnetic characteristics are improved by improving a packing factor of magnetic metal particles within a body.

According to an aspect of the present disclosure, a coil component may include a body having a coil portion embedded therein; and external electrodes connected to the coil portion, wherein the body includes a plurality of magnetic metal particles, and a plurality of indentations are formed in surfaces of at least some of the plurality of magnetic metal particles, and the surfaces of the magnetic metal particles connecting the plurality of indentations to each other are spherical.

A length of the indentation measured from the surface of the magnetic metal particle may be 30 nm to 1 μm.

$D_{50}$ of the plurality of magnetic metal particles may be 20 to 40 μm.

The indentation may have a dendritic shape.

The magnetic metal particle may have a generally spherical shape except for regions in which the plurality of indentations are formed.

At least some of the plurality of indentations may have different sizes.

Indentations having the different sizes among the plurality of indentations may have a similar shape.

At least some of the plurality of indentations may have different shapes.

A crystal grain may not exist on the surface of the magnetic metal particle.

An oxide of a metal constituting the magnetic metal particle may not exist on the surface of the magnetic metal particle.

A coating layer may further be formed on the surface of the magnetic metal particle.

The magnetic metal particle may include an Fe-based alloy.

A content of Fe in the Fe-based alloy may be 75 mol % or more.

The Fe-based alloy may be represented by a composition formula of $(Fe_{(1-a)}M^1{}_a)_{100-b-c-d-e-f-g}M^2{}_bB_cP_dCu_eM^3{}_g$ where $M^1$ is at least one element of Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and a, b, c, d, e, and g have content conditions: $0 \le a \le 0.5$, $0 < b \le 3$, $7 \le c \le 11$, $0 < d \le 2$, $0.6 \le e \le 1.5$, $7 \le g \le 15$, respectively, on the basis of mol %.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
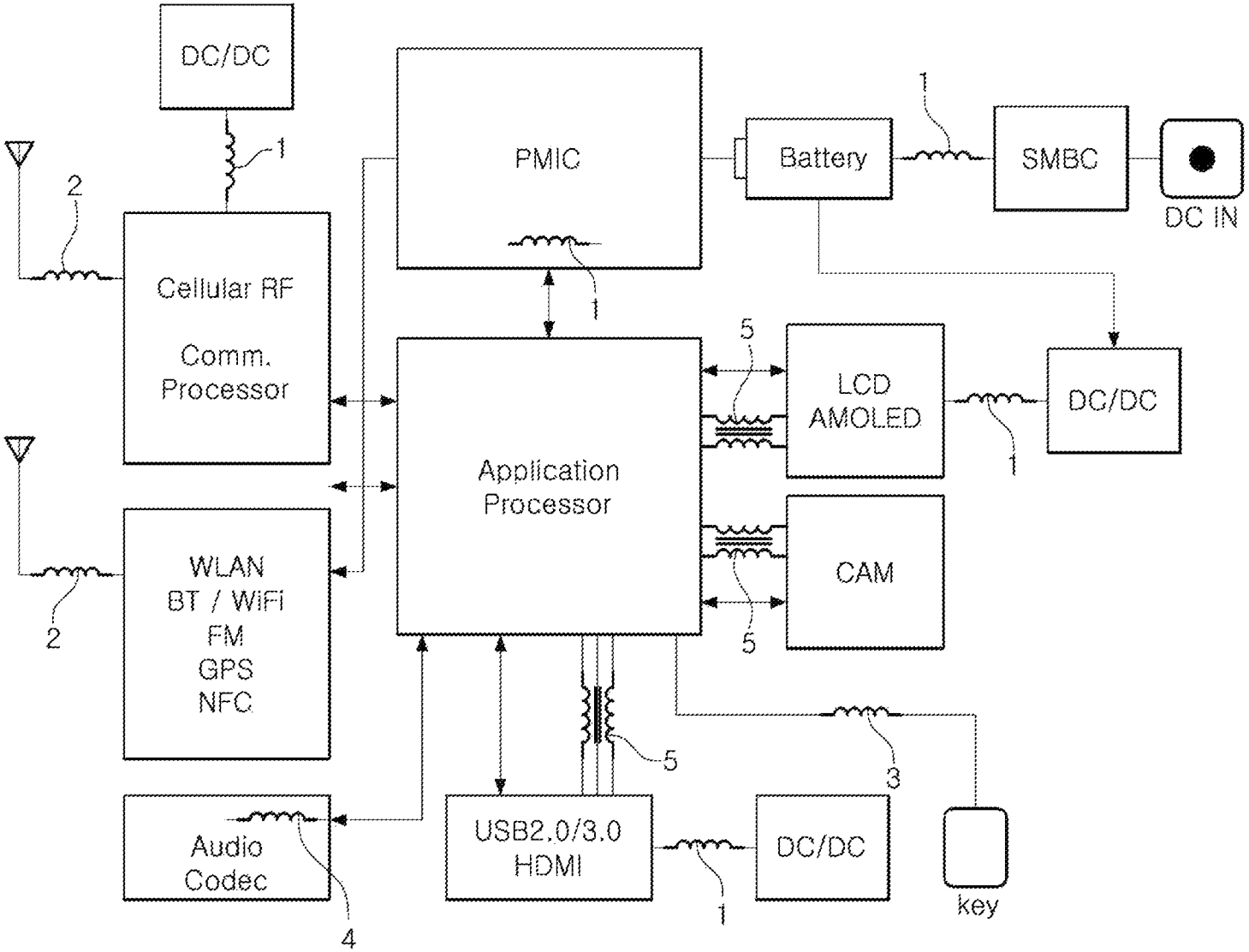
FIG. 1 is a schematic view illustrating an example of a coil component used in an electronic device.

Hereinafter, exemplary embodiments of the present disclosure will be described in detail with reference to the accompanying drawings. The shape and size of constituent elements in the drawings may be exaggerated or reduced for clarity.

It can be understood that when an element is referred to with "first" and "second", the element is not limited thereby. The terms "first," "second," etc. may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

Terms used herein are used only in order to describe an exemplary embodiment rather than limiting the present disclosure. In this case, singular forms include plural forms unless interpreted otherwise in context.

Electronic Device

FIG. 1 is a schematic view illustrating an example of a coil component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USB) 2.0/3.0 a high definition multimedia interface (HDMI), a CAM, and the like, may be used. Here, various kinds of coil components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may typically be a smartphone, but is not limited thereto. The electronic device may also be, for example, a personal digital assistant, a digital video camera, a digital still camera, a network system, a computer, a monitor, a television, a video game, a smartwatch, or the like. The electronic device may also be various other electronic devices well-known in those skilled in the art, in addition to the devices described above.

Coil Component

Hereinafter, a coil component according to the present disclosure, particularly, an inductor, will be described for convenience of explanation. However, the coil component according to the present disclosure may also be used as the coil components for various purposes as described above.

Figure 2:
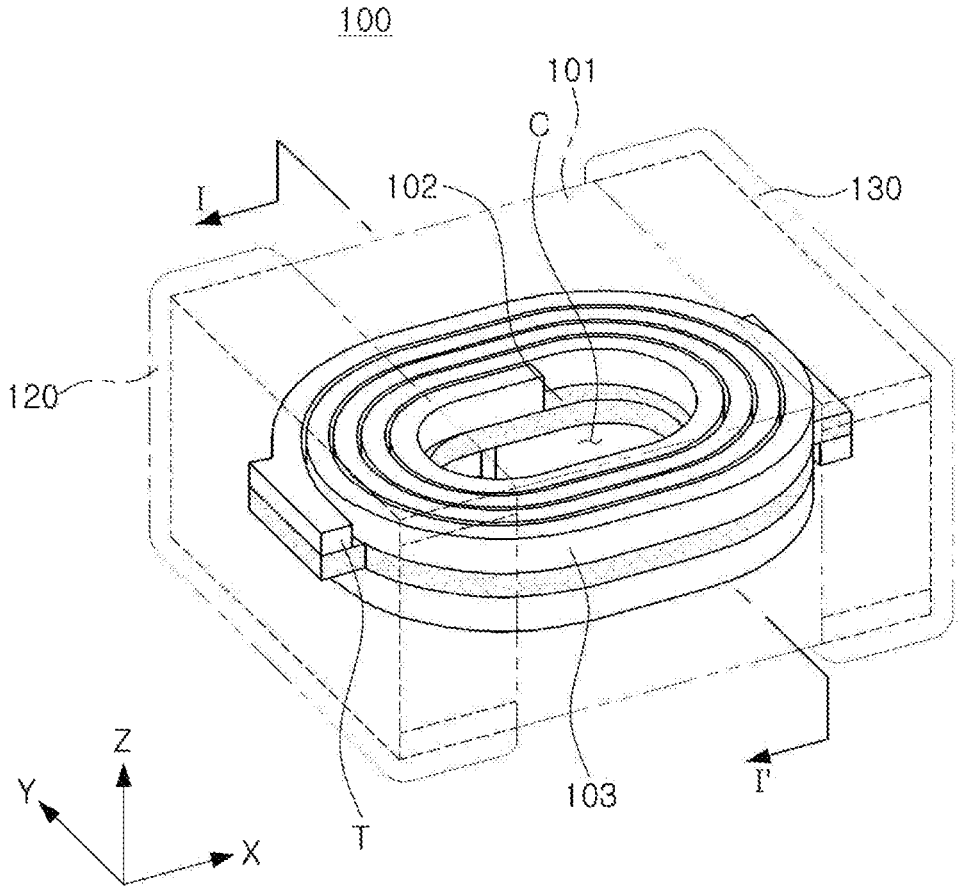
FIG. 2 is a schematic perspective view illustrating a coil component according to an exemplary embodiment in the present disclosure.
Figure 3:
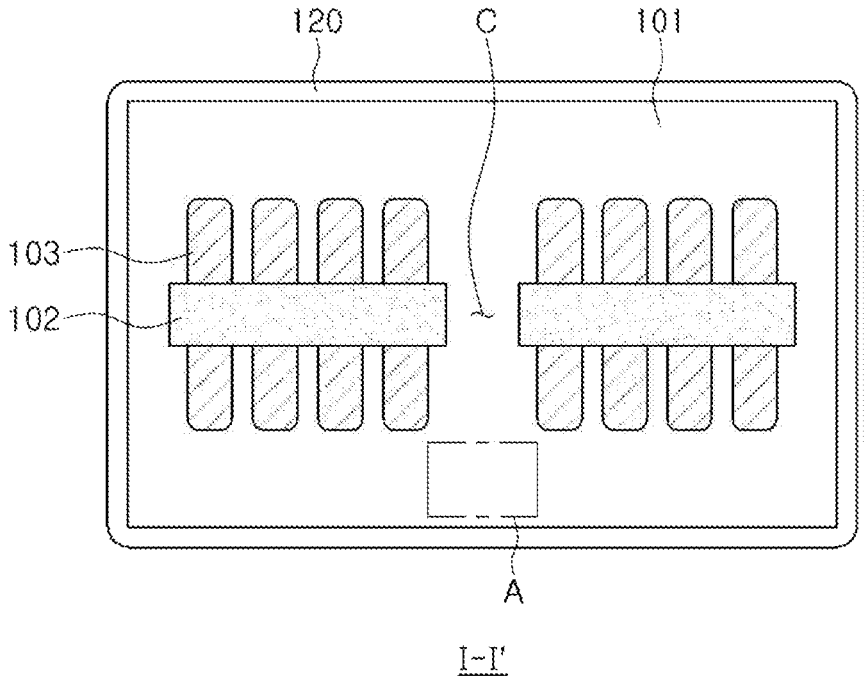
FIG. 3 is a schematic cross-sectional view taken along line I-I' of the coil component of FIG. 2.
Figure 4:
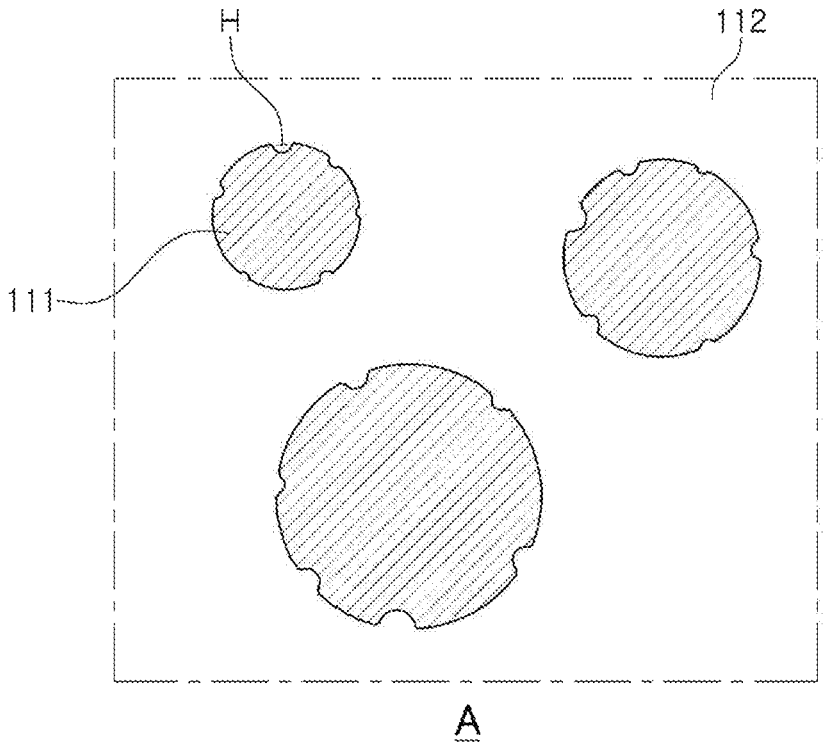
FIG. 4 is an enlarged view illustrating a body region in the coil component of FIG. 3.

FIG. 2 is a schematic perspective view illustrating an appearance of a coil component according to an exemplary embodiment in the present disclosure. In addition, FIG. 3 is a cross-sectional view taken along line I-I' of FIG. 1. FIG. 4 is an enlarged view illustrating a body region in the coil component of FIG. 3.

Referring to FIGS. 2 and 3, a coil component 100 according to an exemplary embodiment in the present disclosure may mainly include a body 101 including a coil portion 103 and a support member 102, and external electrodes 120 and 130. Here, the body 101 may include a plurality of magnetic metal particles 111, and a plurality of indentations H may be formed on surfaces of at least some of the plurality of magnetic metal particles 111.

The body 101 may encapsulate and protect the coil portion 103, and may include the plurality of magnetic metal particles 111 as in a form illustrated in FIG. 3. In this case, the body 101 may have a form in which the magnetic metal particles 111 are dispersed in an insulator 112 formed of a resin, or the like. A material such as a thermosetting resin, a thermoplastic resin, a wax-based material, an inorganic material, or the like, may be used as a material of the insulator 112. The magnetic metal particle 111 may include an Fe-based alloy having excellent magnetic characteristics. Specifically, the magnetic metal particle 111 may include one or more selected from the group consisting of iron (Fe), silicon (Si), chromium (Cr), boron (B), and nickel (Ni). For example, the magnetic metal particle may be an Fe—Si—B—Cr based amorphous metal, but is not necessarily limited thereto. As a more specific example, the magnetic metal particle may be formed of an alloy having an Fe—Si—B—Nb—Cr composition, an Fe—Ni-based alloy, or the like.

As described above, the plurality of indentations H may be formed in the surfaces of at least some of the plurality of magnetic metal particles 111 included in the body 101. In other words, the body includes magnetic metal particles having a substantially spherical shape. It will be understood that the term "substantially" as used in this context means spherical with consideration for imperfections caused by manufacturing process, oxidation of surface particles, crystal grain formation, etc., as well as tolerance for characterization methods. Thus, a particle having, for example, a 5% difference in diameters measured across various pairs of peripheral points (whether because of bumps or indentations, or because of the bulk body) would be considered substantially spherical. With this structure, a magnetic permeability of the body 101 may be improved, and a packing factor of the magnetic metal particles 111 within the body 101 may also be increased. The indentation H formed in the surface of the magnetic metal particle 111 will be described in detail below.

The coil portion 103 may perform various functions in the electronic device through characteristics appearing from a coil of the coil component 100. For example, the coil component 100 may be a power inductor. In this case, the coil portion 103 may serve to store electricity in a magnetic field form to maintain an output voltage, resulting in stabilization of power. In this case, coil patterns constituting the coil portion 103 may be stacked on opposite surfaces of the support member 102, respectively, and may be electrically connected to each other through a conductive via penetrating through the support member 102. The coil portion 103 may have a spiral shape, and include lead portions T formed at the outermost portions of the spiral shape. The lead portions T may be exposed to the outside of the body 101 for the purpose of electrical connection to the external electrodes 120 and 130. The coil patterns constituting the coil portion 103 may be formed by a plating process used in the related art, such as a pattern plating process, an anisotropic plating process, an isotropic plating process, or the like, and may also be formed in a multilayer structure by a plurality of processes of these processes.

The support member 102 supporting the coil portion 103 may be formed of a polypropylene glycol (PPG) substrate, a ferrite substrate, a metal-based soft magnetic substrate, or the like. In this case, a through-hole may be formed in a central region of the support member 102, and a magnetic material may be filled in the through-hole to form a core region C. The core region C may constitute a portion of the body 101. As described above, the core region C filled with the magnetic material may be formed to improve performance of the coil component 100.

The external electrodes 120 and 130 may be formed on the body 101 to be connected to the lead portions T, respectively. The external electrodes 120 and 130 may be formed of a paste including a metal having excellent electrical conductivity, such as a conductive paste including nickel (Ni), copper (Cu), tin (Sn), or silver (Ag), or alloys thereof. In addition, plating layers (not illustrated) may further be formed on the external electrodes 120 and 130. In this case, the plating layers may include one or more selected from the group consisting of nickel (Ni), copper (Cu), and tin (Sn). For example, nickel (Ni) layers and tin (Sn) layers may be sequentially formed in the plating layers.

Figure 5:
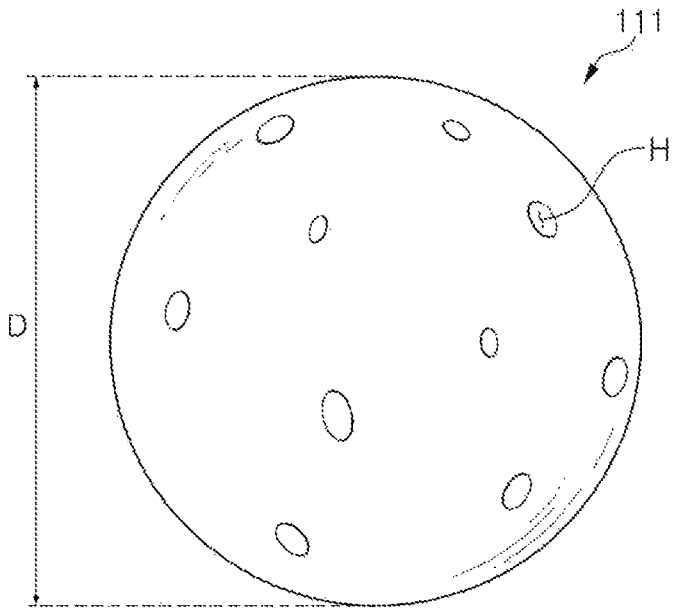
FIGS. 5 through 7 are schematic views illustrating a magnetic metal particle.
Figure 6:
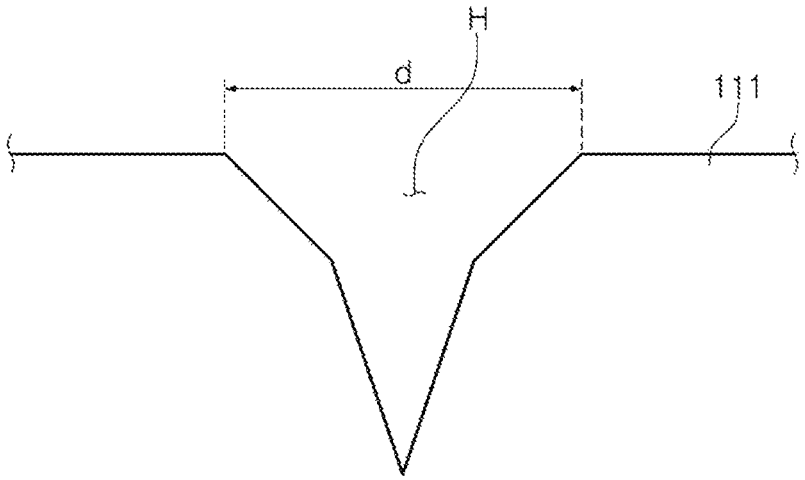
Figure 7:
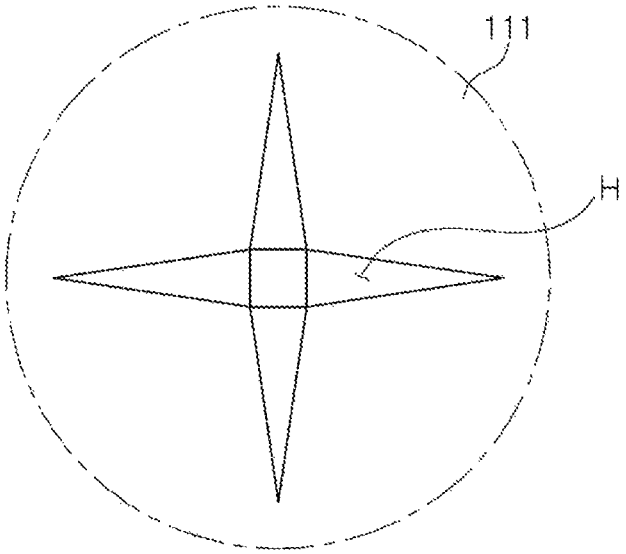

A detailed form of the body 101 will be described with reference to FIGS. 4 through 7. Here, FIGS. 5 through 7 are schematic views illustrating a form of a magnetic metal particle that is usable, wherein FIG. 5 is a perspective view, FIG. 6 is a cross-sectional view, and FIG. 7 is a top view.

As described above, the body 101 may include the plurality of magnetic metal particles 111. In this case, the magnetic metal particle 111 may include an Fe-based alloy. The plurality of indentations H may be formed in the surfaces of the plurality of magnetic metal particles 111. The plurality of indentations H may correspond to etching indentations obtained by processing the magnetic metal particles 111 with an acid solution, or the like, as described below. In a case of the present exemplary embodiment, the entirety of the surface of the magnetic metal particle 111 is not etched, but partial regions of the surface of the magnetic metal particle 111, for example, regions of the surface in which crystal grains exist may be selectively removed. Therefore, the surface of the magnetic metal particle 111 connecting the plurality of indentations H to each other may have a spherical shape. Here, the spherical shape does not refer to a completely spherical surface, and may include a shape similar to a spherical surface or a substantially spherical surface. Meanwhile, it is illustrated in FIG. 4 that all of the plurality of magnetic metal particles 111 have the indentations H, but some of the plurality of the magnetic metal particles 111 may not have the indentations H.

The magnetic metal particle 111 may be produced by an atomized method, or the like, and a content of Fe in the magnetic metal particle 111 may be increased in order to increase a saturation magnetic flux density. Specifically, the magnetic metal particle 111 may include an Fe-based alloy. In this case, a content of Fe in the Fe-based alloy may be 75 mol % or more.

More specifically, a composition of the Fe-based alloy will be described. The Fe-based alloy may be represented by a composition formula of $(Fe_{(1-a)}M^1{}_a)_{100-b-c-d-e-f-g}M^2{}_bB_cP_dCu_eM^3{}_g$, where $M^1$ is at least one element of Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and a, b, c, d, e, and g have content conditions: $0 \le a \le 0.5$, $0 < b \le 3$, $7 \le c \le 11$, $0 < d \le 2$, $0.6 \le e \le 1.5$, $7 \le g \le 15$, respectively, on the basis of mol %.

In a case of the magnetic metal particle 111 obtained by the Fe-based alloy having the composition described above, even in a case in which the magnetic metal particle 111 is implemented to have a relatively large diameter, an amorphous property of a parent phase may be high. Furthermore, in a case of heat-treating the alloy having the high amorphous property as described above, a size of a nano crystal grain may be effectively controlled. In this case, in relation to a size, that is, a diameter D of the magnetic metal particle 111, $D_{50}$ of the plurality of magnetic metal particles 111 may be 20 to 40 μm. As used herein, $D_{50}$ refers to the median diameter or the medium value of the particle size distribution. In other words, $D_{50}$ is the value of the particle diameter at 50% in the cumulative distribution of particle sizes. For example, if $D_{50}$ is 3.5 μm, then 50% of the particles in the sample are larger than 3.5 μm and 50% are smaller than 3.5 μm. The $D_{50}$ value is a given sample is measured using a particle diameter and particle size distribution measuring apparatus using a laser diffraction scattering method.

Meanwhile, in a case where the content of Fe in the Fe-based alloy is relatively large, crystal grains may be formed and oxides due to surface oxidation may be formed, on a surface of a particle obtained from the Fe-based alloy. In a case where such surface crystal grains or surface oxides remain on the magnetic metal particle 111, magnetic characteristics of the body 101 may be deteriorated. In the present exemplary embodiment, magnetic permeability characteristics of the magnetic metal particle 111 may be improved by removing the surface crystal grains and the surface oxides from the magnetic metal particle 111. In this case, the surface crystal grains of the magnetic metal particle 111 may be removed, such that the plurality of indentations H may be formed. The magnetic metal particles 111 having the plurality of indentations H may have a high purity and may have a high packing factor within the body 101 as compared with particles having ruggedness having a protruding form. Therefore, magnetic characteristics of the body 101 may be improved and loss may be decreased.

As described above, a ruggedness is not formed over the entirety of the surface of the magnetic metal particle 111, and only regions of the magnetic metal particle 111 in which the crystal grains exist may be selectively removed, such that the magnetic metal particle 111 may have a generally spherical shape except for regions in which the plurality of indentations H are formed. In addition, at least some of the plurality of indentations H may have different sizes. In this case, indentations having the different sizes among the plurality of indentations H may have a similar shape. These indentations may be obtained by removing surface crystal grains having a similar shape among a plurality of surface crystal grains to form the indentations H. In addition, at least some of the plurality of indentations H may have different shapes, and may be obtained by growing at least some of the surface crystal grains in different shapes.

In relation to a shape of the indentation H, the indentation H may have a shape corresponding to a part of a sphere as in a form illustrated in FIG. 5. In an embodiment, the indentation H may have a dendritic shape as in a form illustrated in FIGS. 6 and 7. The indentation H having the dendritic shape may be obtained in a case in which a crystal grain of an Fe-based alloy has a dendritic shape and is removed by etching. It will be understood that a given magnetic metal particle may have indentations H having different shapes and sizes.

A size of the indentation H may be 30 nm to 1 μm on the basis of a length d measured from a surface of the magnetic metal particle 111. This size may correspond to a size of the surface crystal grain formed in a process of producing the magnetic metal particle 111.

As described above, the crystal grains existing on the surface of the magnetic metal particle 111 may be removed by an etching process. Therefore, the crystal grains may not exist on the surface of the magnetic metal particle 111. In addition, the surface oxides of the magnetic metal particle 111 may also be removed by the etching process. Therefore, oxides of a metal constituting the magnetic metal particle 111, such as Fe, may not exist on the surface of the magnetic metal particle 111.

Figure 8:
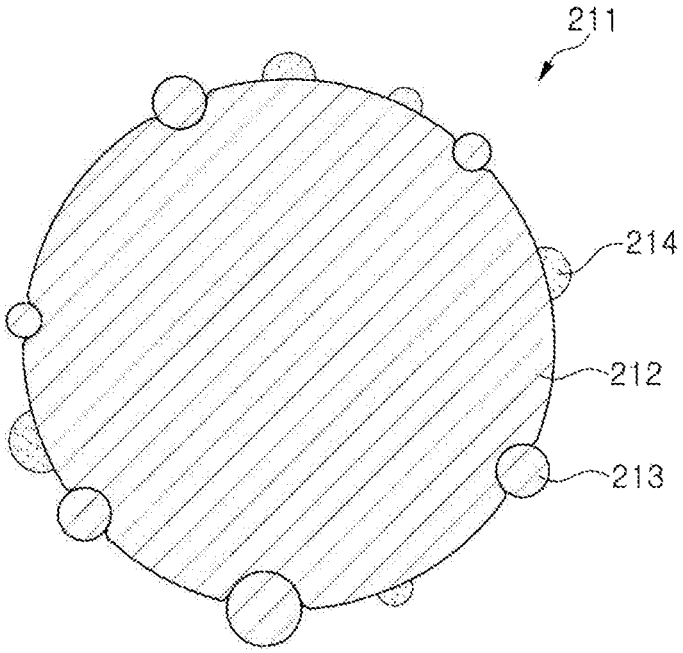
FIGS. 8 through 10 are views illustrating processes of producing a magnetic metal particle.

A process of producing a magnetic metal particle will be described with reference to FIGS. 8 through 10. FIG. 8 schematically illustrates a form in which a magnetic metal particle 211 is implemented by an atomized method, or the like, and crystal grains 213 and oxides 214 are formed on a surface of the magnetic metal particle 211. In this case, the crystal grains 213 and the oxides 214 are not formed over the entirety of the surface of the magnetic metal particle 211, and may be formed on only partial regions of the surface of the magnetic metal particle 211. Therefore, the magnetic metal particle 211 may be maintained in a generally spherical shape. A main portion 212 of the magnetic metal particle 211 except for the crystal grains 213 and the oxides 214 may be amorphous, but nano crystal grains may exist in partial regions of the main portion 211. Also in this case, crystal grains may not exist on a surface of the main portion 212.

Figure 9:
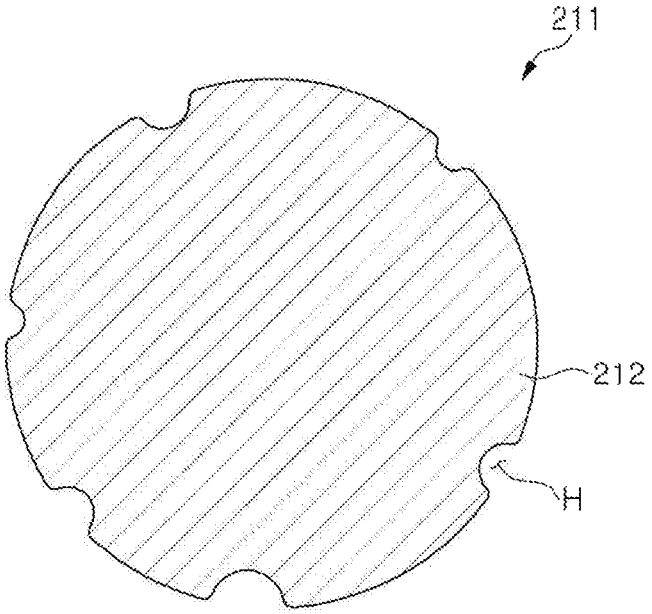
Figure 10:
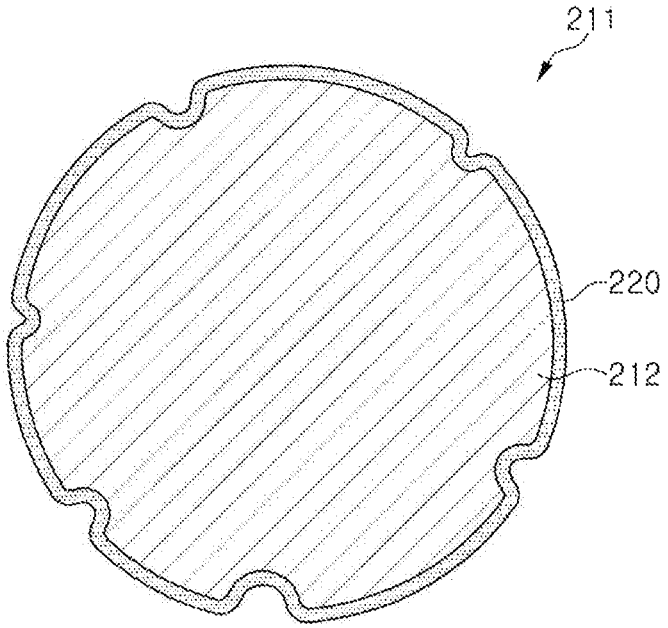

FIG. 9 illustrates the magnetic metal particle 211 after an etching process. The crystal grains 213 and the oxides 214 may be removed by etching the magnetic metal particle 211 with an acid solution, or the like. Therefore, the magnetic metal particle 211 may have a plurality of indentations H formed in a surface thereof, and the indentations H may be connected to each other by a spherical surface. The present etching process may be executed using, for example, a phosphoric acid-based solution, a hydrochloric acid-based solution, a sulfuric acid-based solution, and the like. In a case of using the phosphoric acid-based solution among them, the crystal grains 213 and the oxides 214 may be effectively removed while surface etching of other regions in the magnetic metal particle 211 is significantly suppressed. The surface of the magnetic metal particle 211 may be coated with a resin, an oxide, or the like, during or after the etching process of the magnetic metal particle 211 to protect the magnetic metal particle 211. FIG. 10 illustrates a form in which a coating layer 220 is formed on the surface of the magnetic metal particle 211. As in the form illustrated in FIG. 10, the coating layer 220 may be implemented in a form following a shape of the magnetic metal particle 211 along the surface of the magnetic metal particle 211. However, according to another exemplary embodiment, a costing process of FIG. 10 may be omitted.

Meanwhile, the present inventors have produced magnetic metal particles according to Inventive Examples and Comparative Examples and have then measured contents of oxygen, packing factors, magnetic permeabilities of bodies implemented through the magnetic metal particles. Here, the contents of oxygen are to obtain information on amounts of oxides on surfaces. In Comparative Examples 1 and 2, contents of Fe were 79 mol % and 76 mol %, respectively, and an etching process was not performed on magnetic metal particles, such that crystal grains and oxides have existed on surfaces of the magnetic metal particles. In Comparative Example 3, a content of Fe was 79 mol %, and surface-treatment was performed on a magnetic metal particle in a dry friction manner after the magnetic metal particle is produced. According to such a surface treatment manner, crystal grains and oxides remain on the surface of the magnetic metal particle without being effectively removed due to a force such as an electrostatic force, or the like. Meanwhile, Fe-based alloys according to Comparative Examples 1 and 3 were amorphous, and an Fe-based alloy according to Comparative Example 2 was in a state in which some nano crystal grains are precipitated through heat treatment.

In Inventive Examples 1 and 2, compositions in which contents of Fe were 79 mol % and 76 mol %, respectively, were used, and a plurality of indentations were formed on surfaces of magnetic metal particles through surface treatment using a phosphoric acid-based solution. An Fe-based alloy according to Inventive Example 1 was amorphous, and an Fe-based alloy according to Inventive Example 2 was in a state in which some nano crystal grains are precipitated through heat treatment.

TABLE 1

| | Content of Oxygen (ppm) | Packing Factor (%) | Magnetic Permeability |
|---|---|---|---|
| Comparative Example 1 | 1.000 | 80.5 | 35.4 |
| Comparative Example 2 | 800 | 80.5 | 37.8 |
| Comparative Example 3 | 980 | 81.4 | 37.3 |
| Inventive Example 1 | 800 | 81.8 | 40 |
| Inventive Example 2 | 700 | 82.1 | 42 |

It could be seen from an experiment result of Table 1 that when the plurality of indentations are formed in the surface of the magnetic metal particle by an etching process as in Inventive Examples, amounts of oxides are smaller than those of Comparative Examples and packing factors and magnetic permeabilities are more excellent than those of Comparative Examples under the same condition.

As set forth above, in the coil component according to an exemplary embodiment in the present disclosure, the magnetic metal particles from which the oxides and the crystal grains having a large size are effectively removed are used, such that a magnetic permeability may be improved and a packing factor of the magnetic metal particles within the body may be improved.

While exemplary embodiments have been shown and described above, it will be apparent to those skilled in the art that modifications and variations could be made without departing from the scope of the present invention as defined by the appended claims.

What is claimed is:

1. A coil component comprising:

a body having a coil portion embedded therein; and external electrodes connected to the coil portion, wherein the body includes a plurality of magnetic metal particles having a substantially spherical shape, and at least some of the plurality of magnetic metal particles have a plurality of indentations in surfaces thereof, the plurality of indentations having a dendritic shape.

2. The coil component of claim 1, wherein a length of the plurality of indentations measured from the surface of the plurality of magnetic metal particles is in a range from 30 nm to 1 μm.

3. The coil component of claim 1, wherein D50 of the plurality of magnetic metal particles is 20 to 40 μm.

4. The coil component of claim 1, wherein the plurality of indentations has a shape corresponding to a crystal grain being removed from the surface of the magnetic particles.

5. The coil component of claim 1, wherein at least some of the plurality of indentations have different sizes.

6. The coil component of claim 5, wherein indentations having the different sizes among the plurality of indentations have a similar shape.

7. The coil component of claim 1, wherein at least some of the plurality of indentations have different shapes.

8. The coil component of claim 1, wherein crystal grains are absent at the surfaces of the plurality of magnetic metal particles.

9. The coil component of claim 1, wherein an oxide of a metal constituting the plurality of magnetic metal particles is absent at the surfaces of the plurality of magnetic metal particles.

10. The coil component of claim 1, wherein a coating layer is further disposed on the surfaces of the plurality of magnetic metal particles.

11. The coil component of claim 1, wherein the plurality of magnetic metal particles includes an Fe-based alloy.

12. The coil component of claim 11, wherein a content of Fe in the Fe-based alloy is 75 mol % or more.

13. The coil component of claim 11, wherein the Fe-based alloy is represented by a composition formula of $(Fe_{(1-a)}M^1{}_a)_{100-b-c-d-e-f-g}M^2{}_bB_cP_dCu_eM^3{}_g$, where $M^1$ is at least one element of Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and a, b, c, d, e, and g have content conditions: $0 \le a \le 0.5$, $0 \le b \le 3$, $7 \le c \le 11$, $0 \le d \le 2$, $0.6 \le e \le 1.5$, $7 \le g \le 15$, respectively, on the basis of mol %.

14. A coil component comprising:

a body having a coil portion embedded therein; and external electrodes connected to the coil portion, wherein the body includes magnetic metal particles having a substantially spherical shape, at least some of the magnetic metal particles have indentations in surfaces thereof, the magnetic metal particles comprising an Fe-based alloy comprising boron, phosphorus and copper, and wherein an oxide of a metal constituting the plurality of magnetic metal particles is absent at the surfaces of the plurality of magnetic metal particles.

15. A coil component comprising:

a body having a coil portion embedded therein; and external electrodes connected to the coil portion, wherein the body includes magnetic metal particles having a substantially spherical shape, at least some of the magnetic metal particles have indentations in surfaces thereof, the magnetic metal particles comprising an Fe-based alloy comprising boron, phosphorus and copper, and wherein crystal grains are absent at the surfaces of the plurality of magnetic metal particles.

* * * * *